United States Patent [19]

Gordon et al.

[11] Patent Number: 4,976,411

[45] Date of Patent: Dec. 11, 1990

[54] CHRISTMAS TREE STAND

[76] Inventors: Ian A. Gordon, 34 Colville Street, Carlisle, Cumbria CA2 5HT; Howard J. Foster, 12 London Road Terrace, Carlisle, Cumbria Ca1 2PF, both of England

[21] Appl. No.: 430,368

[22] Filed: Nov. 2, 1989

[30] Foreign Application Priority Data

Nov. 11, 1988 [GB] United Kingdom ..... 8826435

[51] Int. Cl.[5] ..... F16M 13/00

[52] U.S. Cl. ..... 248/524; 211/194

[58] Field of Search ..... 248/519, 523, 524; 220/23.6; 47/40.5; 211/194; 206/501

[56] References Cited

U.S. PATENT DOCUMENTS

| | | | |
|---|---|---|---|
| 2,609,169 | 9/1952 | Kroeger | 47/40.5 |
| 2,613,899 | 10/1952 | Wagner | 47/40.5 |
| 3,302,909 | 2/1967 | Glassman | 47/40.5 |
| 3,424,334 | 1/1969 | Goltz | 220/23.6 |
| 4,222,545 | 9/1980 | Patton | 248/524 |
| 4,544,351 | 10/1985 | Marsicano | 248/523 X |
| 4,596,262 | 6/1986 | Tegze | 47/40.5 X |

*Primary Examiner*—J. Franklin Foss

*Attorney, Agent, or Firm*—Abelman Frayne Rezac & Schwab

[57] ABSTRACT

A Christmas tree stand comprises a lower, upwardly-open, downwardly-tapering socket for receiving the lower end of the trunk of the tree, an outer wall surrounding the socket and a top wall of a resilient plastics material capping the outer wall. A central aperture is formed through the top wall to overlie the socket and of a diameter substantially equal to that of the smallest trunk to be received within the stand, a plurality of substantially radial slots being formed in the top wall to define a plurality of leaves each of generally truncated sector shape and resiliently yieldable on the insertion therethrough and withdrawal therefrom of the trunk.

8 Claims, 2 Drawing Sheets

CHRISTMAS TREE STAND

BACKGROUND OF THE INVENTION

This invention relates to a Christmas tree stand.

It is known to provide stands for Christmas trees which are capable of receiving and supporting therein the lower ends of trunks of varying diameters. Such stands are disclosed in, for example, U.S. Pat. Nos. 2,044,192, 3,058,707 and 3,302,909.

However, all of these stands utilise relatively complex mechanical means for gripping the trunk of the tree and are therefore expensive to manufacture and prone to loss or breakage of components essential to the supporting of the tree in the stand.

It has been proposed, for example in U.S. Pat. No. 2,750,138, to provide a stand incorporating a receiving portion for the trunk of a tree in the form of a cylindrical metal container the top wall of which is radially slit whereby the trunk can be forced through, to be partially supported by, the leaves defined by the radial slits.

However, such an arrangement requires the provision of an additional stand to support, and provide stability to, the container, while the sharp nature of the radial slit configuration in the top wall of the metal container could lead to sever damage both to the trunk of the associated tree and to the fingers of a user should they be inadvertently poked into the container.

Further, once deformed into their operative positions gripping a trunk, the leaves of the top wall of the container cannot readily be returned to their rest positions for subsequent re-use of the stand.

SUMMARY OF THE INVENTION

It is an object of the invention to provide a stand for a Christmas tree of relatively simple construction capable of receiving a range of trunk diameters and which overcomes the aforementioned problems of the known arrangements.

According to the present invention, there is provided a Christmas tree stand comprising a lower, upwardly-open, downwardly-tapering socket for receiving therein the lower end of the trunk of the tree, and an outer wall surrounding the socket and capped by a transverse top wall of a resilient plastics material, the top wall defining therethrough a central aperture overlying the socket and of a diameter substantially equal to that of the smallest trunk to be received within the stand, and a plurality of substantially radial slots formed in said top wall to define a plurality of leaves each of generally truncated sector shape and resiliently yieldable on the insertion therethrough and withdrawal therefrom of the trunk.

It will be appreciated that the provision of a central aperture in a top wall of a resilient plastics material not only provides a lead-in for the lower end of the trunk on location of a tree in the stand but also substantially eliminates the possibility of damage to the trunk or to the fingers of the user.

Further, the resilient nature of the leaves in the top wall enables ready insertion and removal of a trunk, the stand being re-usable without the requirement of any servicing thereto.

In a preferred embodiment of the invention, the locations and configurations of the socket and of the central aperture in the top wall of the stand are such that two stands can be partially nested, with the lower regions of the socket of one stand received within, to project through, the central aperture in the top wall of the other stand.

The nestable nature of the stands substantially reduces the volume required for storage of the stands by a retailer or wholesaler.

The outer wall of the lower regions of the socket of a stand may be provided with a circumferential ridge or a plurality of circumferentially spaced projections adapted to project through the central aperture in the top wall of the other stand and to co-operate with the radially inner edges of the leaves of the top wall of the other stand to effect positive nesting between the two stands.

Preferably the inner wall of the socket has a plurality of circumferentially-spaced, longitudinal ribs formed thereon.

Conveniently the stand comprises an upwardly-tapering, frusto-conical inner wall within the outer wall and surrounding the socket, the upper rim of the socket being integral with, and supported by, the upper rim of the inner wall.

Preferably the top wall of the stand is surrounded by a peripheral upstanding ridge. Such a ridge, as well as providing rigidity to the stand, defines, together with the top wall, a hollow upper region to the stand into which water can be poured for watering the tree.

The stand may be blow-moulded from a plastics material such as polypropylene or high density polyethylene and may comprise a one-piece moulding.

Alternatively the stand may comprise a plurality of components and may include, for example, a removable and replaceable top wall.

DESCRIPTION OF THE PREFERRED EMBODIMENT

Figure 1:
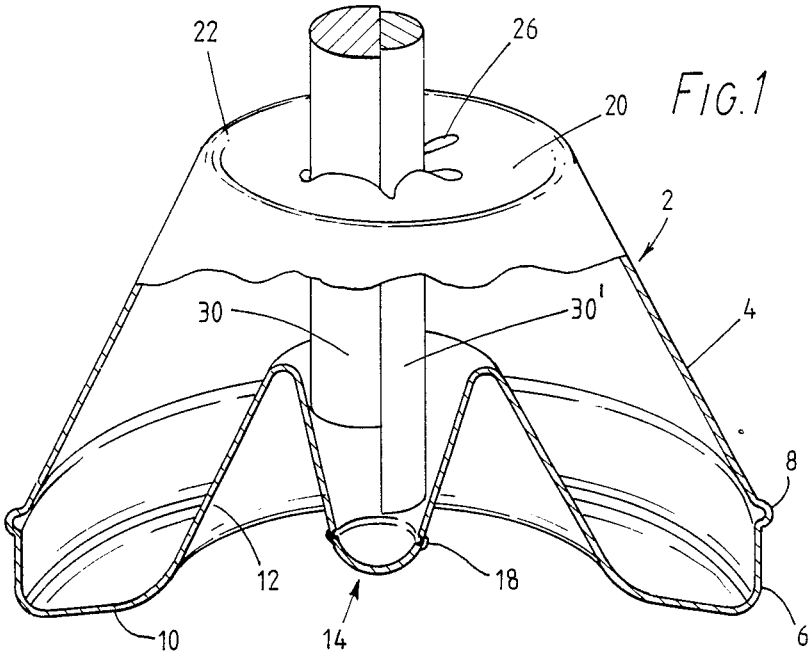
FIG. 1 is a partial vertical section through a stand according to the invention showing parts of two trunks of different diameters received therein.

Referring to the drawings, the illustrated stand comprises a one-piece blow moulding of, for example, polypropylene or high density polyethylene and includes an outer wall 2 having an upper region 4 of upwardly-tapering, generally frusto-conical shape and a lower region 6 of generally cylindrical shape, the upper and lower regions 4,6 including a circumferential ridge 8 therebetween.

The lower region 6 of the outer wall 2 merges into an annular base portion 10 in which the stand is supported, the base portion 10 being integral with an upwardly-tapering, generally frusto-conical inner wall 12 contained within the outer wall 2 and terminating at a level just above that of the ridge 8.

The lower regions of the stand are completed by an upwardly-open socket indicated generally at 14 and of generally inverted conical shape, the upper rim of the socket 14 being integral with the upper edge of the inner wall 12 and the base of the socket 14 being located just above the level of the base portion 10 of the stand.

The internal wall of the socket 14 has three longitudinal, equi-spaced ribs 16 formed thereon, while a circumferential ridge 18 is formed around the lower regions of the outer wall of the socket 14 for reasons which will become apparent.

The stand is completed by a circular transverse top wall 20 between the periphery of which and the upper region 4 of the outer wall 2 is formed an upstanding, circumferential ridge 22, whereby the top wall 20 and the ridge 22 together form a hollow bowl in the upper region of the stand.

Formed centrally through the top wall 20 is a circular aperture 24 the diameter of which is just less than the diameter of the smallest trunk to be supported in the stand. A plurality of radial slots 26 extend outwardly from the aperture 24 to define a corresponding plurality of leaves 28 each of generally truncated sector shape. The material and configuration of the leaves 28 make them resiliently yieldable to upward or downward pressure thereon, while the resultant top wall 20 is of slightly upwardly convex shape.

The described stand can be used to support Christmas trees the trunks of which have a diameter between predetermined upper and lower limits, typically between about 30 mm and 75 mm. The diameter of the aperture may typically be about 30 mm.

In use, the butt end of the trunk of a Christmas tree is located over the aperture 24 in the top wall 20 and is then pushed downwardly therethrough, the aperture 24 providing a lead-in for such movement. The resilient leaves 28 are displaced downwardly by this movement of the tree, which downward movement of the tree is continued until the butt end of the trunk seats in, and engages the tapering side walls/ribs 16 of, the socket 14.

Figure 5:
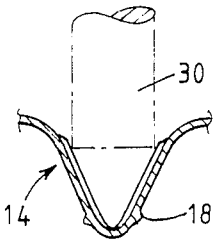
FIGS. 5 and 6 are vertical sections through the socket of the stand of FIGS. 2 and 3 showing therein trunks of maximum and minimum diameters respectively capable of being held by the stand.
Figure 6:
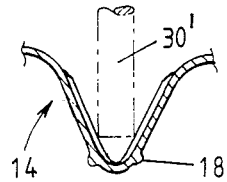
Figure 4:
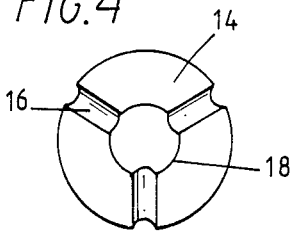
FIG. 4 is a plan view from below of the socket of the stand of FIGS. 2 and 3.

FIG. 5 shows the location of the butt end 30 of a trunk of the maximum diameter received in the upper regions of the tapering socket 14, while FIG. 6 shows the butt end 30' of a trunk of the minimum diameter received in the lower regions of the tapering socket 14. In both cases, the longitudinal ribs 16 supplement the location of the butt end 30,30' in the socket 14.

In this operative position of the Christmas tree in the stand, the bottom end of the trunk is supported by the socket 14, with the resiliently displaced leaves 28 gripping the trunk to locate the tree in an upright position. FIG. 1 shows the relative positions of the butt ends 30,30' of FIGS. 5 and 6 in the operative position of the stand, as well as the displaced positions of the leaves 28. Clearly, the larger the diameter of the tree trunk, the more displacement will there be on the leaves 28 and the more tightly will the trunk be gripped. The hollow interior of the stand is filled with water.

Removal of the tree from the stand is achieved by raising the tree vertically relative to the stand against the bias of the leaves 28 until the butt end of the tree is free of the top wall 20. After removal, the leaves 28, being of resilient, visco-elastic material, return to their initial configuration, the slightly upwardly convex shape of the top wall 20, as well as reducing the differences in forces required to insert and remove the tree and reducing the stress on the stand during removal of the tree, compensating for any slight downward deformation of the leaves that may occur from extended use of the stand.

As mentioned above, the inner ends of the leaves 28 have blunt ends which ensures that the leaves grip the butt end of the trunk but do not bite into the bark of the tree, thus permitting ready removal of the tree from the stand. Further, such a configuration reduces the possibility of accidental damage to a user's fingers.

The leaves 28 provide self-centring of the tree in the stand, but, unlike the known shape metal leaves, also allow the butt end of the trunk to be deliberately offset as may be required with a bent or slightly deformed trunk.

The slots 26 in the top wall 20 are generously radiused at their outer ends to minimise stress concentration in the material of the top wall 20 and to prevent accidental tearing of the material of the top wall 20. These slots 26 are thus of a specific length and are not extended or torn by the insertion of a tree.

The provision of the annular base portion 10 ensures 360 degree contact of the stand with the floor and at the outside diameter of the stand, thus providing maximum stability and spreading the load on the stand to reduce marking of a carpet or the like. Such an arrangement also permits a stand/tree assembly to be easily slid around the floor to permit optimum positioning thereof.

The socket 14 is deliberately positioned above the level of the base portion 10, and therefore clear of the floor, to maximise stability of the stand and to prevent contact of the socket 14 even with thick soft carpets.

The hollow bowl formed in the upper region of the stand by the top wall 20 and the ridge 22 enables water to be poured onto the top wall 20 and to penetrate through the slots 26 to replenish the water already stored in the interior of the stand. The ridge 22 also adds rigidity to the stand.

A major feature of the described stand is that two or more stands can be partly-nested one within another.

Figure 7:
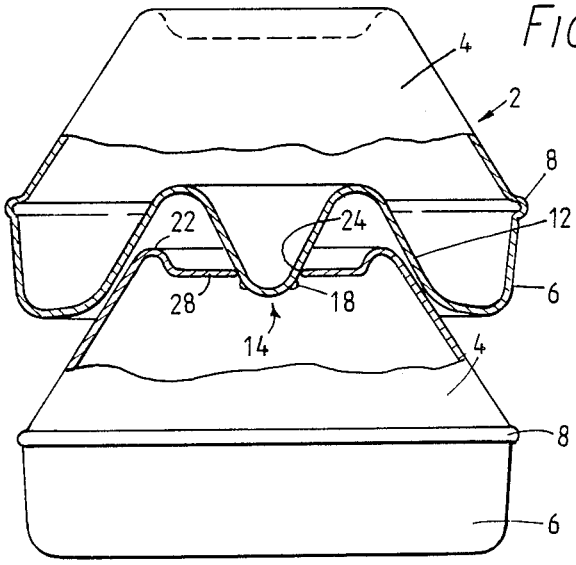
FIG. 7 shows, in partial vertical sections, two stands according to the invention nested one within the other.
Figure 2:
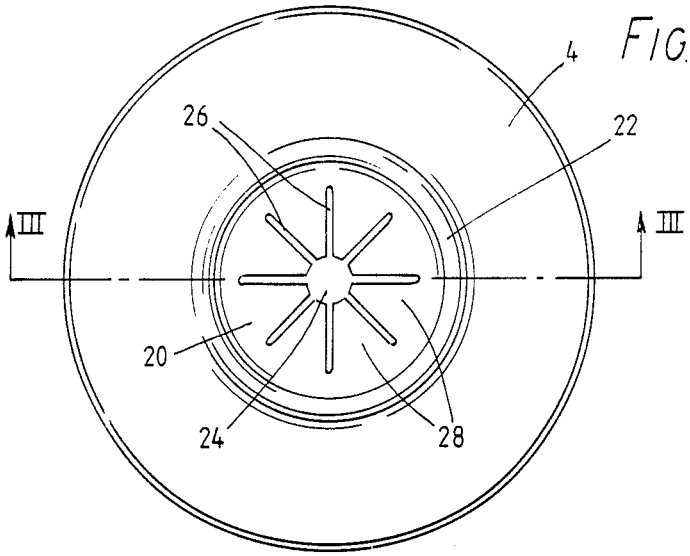
FIG. 2 is a plan view from above of a stand according to the invention.
Figure 3:
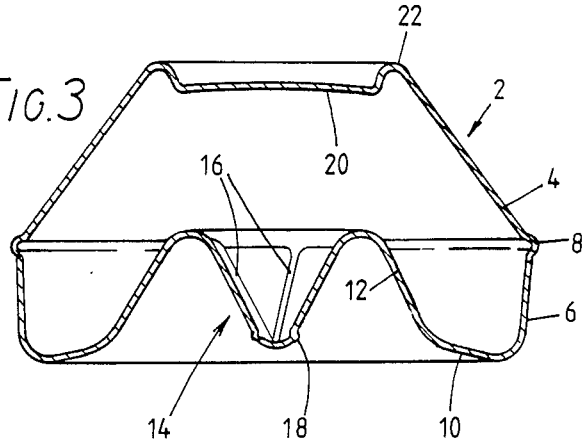
FIG. 3 is a vertical section on the line III—III of FIG. 2.

More particularly, the configurations of the upper region 4 of the outer wall 2 and the inner wall 12, as well as the diameters and relative locations of the lower regions of the socket 14 and the aperture 24 in the top wall 20, enable partial nesting of two stands as shown in FIG. 7, with the upper region 4 of the outer wall 2 of one stand received within the lower regions of the inner wall 12 of another stand, and with the lower regions of the socket 14 of the other stand projecting through the aperture 24 in the top wall 20 of the one stand.

The circumferential ridge 18 formed around the socket 14 is located such that, with two stands nested as shown in FIG. 7 and with the walls 2,12 of the two stands substantially abutting, the ridge on the socket 14 of the upper stand has snapped through the central aperture 24 in the top wall 20 of the lower stand to co-operate with the free ends of the leaves 28 and to provide a small but positive interlocking between the two stands. Clearly such nestability is a distinct advantage to a stockist of the stands, substantially reducing the storage volume required for his stock and facilitating transport of the stands.

Although described as a one-piece moulding, the stand could comprise a plurality of interconnected components and could include a removable top wall 20 which could be removed as required or replaced by a substitute wall for use with other than Christmas trees during other than the Christmas period.

The material of the stand is such that it is re-usable time and time again, the resiliency of the leaves 28 being such as to withstand several insertions and removals of a tree trunk without permanently deforming the top wall 20. Blow-moulding of an integral unit has the advantage that the thickness of the material at various regions within the stand can be varied, for example being thick over the main body portion of the stand to prevent puncture and leakage of water therefrom, but being thinner at the leaves 28 to provide the desired resiliency.

An integral unit further elininates the possiblity of losing a component of the stand as exists with current arrangements, while no tools are required to mount a tree in the stand of the invention.

The stand may be ballasted with water, sand or pebbles or a combination of these, water having the advantage of keeping the tree fresh.

The exterior of the stand may be provided with an integrally moulded or separately added, motif, pattern of instructions for use.

I claim:

1. A Christmas tree stand comprising a lower, upwardly-open, downwardly-tapering socket for receiving therein the lower end of the truck of the tree, an outer wall surrounding the socket and a transverse top wall of a resilient plastics material capping said outer wall, the top wall defining therethrough a substantially circular central aperture overlying the socket and of a diameter substantially equal to that of the smallest trunk to be received within the stand, and a plurality of substantially radial slots formed in said top wall and each having a width in the plane of the top wall, the slots defining between them a plurality of leaves each of which generally truncated sector shape, the leaves having side edges thereto, the side edges of adjacent leaves being spaced from one another by the width of a slot, the leaves being resiliently yieldable on the downward insertion therethrough and the upward withdrawal therefrom of the trunk.

2. A stand as claimed in claim 1 in which the socket has lower regions thereto, the locations and configurations of the socket and of the central aperture in the top wall of the stand being such that two stands can be partially nested with the lower regions of the socket of one stand received within, to project through, the central aperture in the top wall of the other stand.

3. A stand as claimed in claim 2 in which the lower regions of the socket have an outer wall, a circumferential ridge being formed on said outer wall and being adapted to project through the central aperture in the top wall of the other stand and to co-operate with the leaves of the top wall of the other stand to effect positive nesting between the two stands.

4. A stand as claimed in claim 3 in which the socket has an inner wall, a plurality of circumferentially-spaced, longitudinal ribs being formed on said inner wall of the socket.

5. A stand as claimed in claim 1 and comprising an upwardly-tapering, frusto-conical inner wall within the outer wall and surrounding the socket, the socket and the inner wall each having an upper rim, the upper rim of the socket being integral with, and supported by, the upper rim of the inner wall.

6. A stand as claimed in claim 1 and comprising a peripheral, upstanding ridge surrounding the top wall.

7. A stand as claimed in claim 1 which the socket, the outer wall and the top wall comprise a blow-moulded plastics material.

8. A stand as claimed in claim 7 in which the socket, the outer wall and the top wall comprise a one-piece moulding.

* * * * *